US009402451B2

(12) United States Patent
Sterns

(10) Patent No.: US 9,402,451 B2
(45) Date of Patent: Aug. 2, 2016

(54) TRAVEL TOTE

(71) Applicant: Tammy S. Sterns, Sioux Center, IA (US)

(72) Inventor: Tammy S. Sterns, Sioux Center, IA (US)

( * ) Notice: Subject to any disclaimer, the term of this patent is extended or adjusted under 35 U.S.C. 154(b) by 0 days.

(21) Appl. No.: 14/157,675

(22) Filed: Jan. 17, 2014

(65) Prior Publication Data

US 2014/0202919 A1 Jul. 24, 2014

Related U.S. Application Data

(60) Provisional application No. 61/754,270, filed on Jan. 18, 2013.

(51) Int. Cl.

*A45C 5/00* (2006.01)
*A45C 7/00* (2006.01)
*A45C 13/02* (2006.01)

(52) U.S. Cl.

CPC ..... *A45C 5/005* (2013.01); *A45C 7/0054* (2013.01); *A45C 2013/026* (2013.01)

(58) Field of Classification Search

CPC ..... B65D 77/044; B65D 85/00; A45C 5/005; A45C 7/0054; A45C 2013/026; A47K 5/00; A47K 3/281; A45D 40/22; Y10S 206/806

USPC ..... 206/77.1, 581, 277, 235, 806, 229; 132/310, 315; 190/109, 901

See application file for complete search history.

(56) References Cited

U.S. PATENT DOCUMENTS 3,074,452 A * 1/1963 Bridges ..... 383/23
3,078,017 A * 2/1963 Waskonig et al. ..... 222/181.3
4,232,721 A * 11/1980 Martin et al. ..... 383/120
D308,925 S * 7/1990 Laseca et al. ..... D6/525
4,958,727 A 9/1990 Bergeron
5,007,531 A 4/1991 Lighten
5,044,522 A * 9/1991 Roig et al. ..... 222/108
5,095,924 A * 3/1992 Stanfield ..... 132/315
5,148,926 A * 9/1992 Cocuzzo et al. ..... 211/118
5,299,683 A 4/1994 Poole (Continued)

FOREIGN PATENT DOCUMENTS

GB 941039 11/1963

OTHER PUBLICATIONS humangear "The civilized, squeezable travel tube", http://humangear.com/gotoob [retrieved from the Internet Apr. 4, 2014], 5 pages. Apr. 4, 2014.

*Primary Examiner* — Steven A. Reynolds
(74) *Attorney, Agent, or Firm* — McKee, Voorhees & Sease, PLC

(57) ABSTRACT

A portable article, which may be a portable tote for use in traveling or otherwise non-permanent use, is provided. The article includes first and second sections that may be foldably connected to allow for an open and closed configuration. Handles and snaps or other connection members are connected to the sections to allow for carrying and holding the article closed, which will aid in the mitigation of items falling out of the article. One of the sections includes one or more protrusions extending therefrom. Attached to the one or more protrusions is a tube for holding a product. The tube includes an aperture through a portion thereof to allow for the protrusion to extend at least partially therethrough, which will at least temporarily hold the tube in place and connected to the article. Other holders may be included to hold additional items within the article as well.

13 Claims, 9 Drawing Sheets

(56) References Cited

U.S. PATENT DOCUMENTS

| | | | | |
|---|---|---|---|---|
| 5,351,346 | A * | 10/1994 | Hodges, Jr. | 4/605 |
| 5,433,230 | A * | 7/1995 | Miller | 134/110 |
| 5,533,534 | A * | 7/1996 | Cariello et al. | 132/286 |
| 5,819,984 | A * | 10/1998 | Krueger | 222/181.2 |
| 6,065,649 | A * | 5/2000 | Scoggins | 222/181.2 |
| 6,109,442 | A * | 8/2000 | Roegner | 206/581 |
| 6,135,322 | A * | 10/2000 | Cetrangolo | 222/105 |
| 6,241,388 | B1 * | 6/2001 | Terramani | 383/22 |
| 6,578,707 | B2 * | 6/2003 | Staiano | 206/236 |
| 6,640,813 | B2 * | 11/2003 | Raisner et al. | 132/200 |
| 7,040,024 | B2 * | 5/2006 | Lukan et al. | 30/541 |
| 7,261,221 | B2 * | 8/2007 | Awbrey et al. | 222/181.3 |
| 7,854,317 | B1 * | 12/2010 | Hebert et al. | 206/223 |
| 7,942,114 | B2 * | 5/2011 | Hillios et al. | 119/230 |
| 8,387,783 | B2 * | 3/2013 | Zack et al. | 206/77.1 |
| 2001/0035430 | A1 | 11/2001 | Litscher | |
| 2003/0071075 | A1 * | 4/2003 | Frankenbach et al. | 222/383.1 |
| 2003/0098249 | A1 * | 5/2003 | Rollock | 206/63.5 |
| 2005/0109662 | A1 * | 5/2005 | Kirk | 206/581 |
| 2006/0261097 | A1 | 11/2006 | Bailey | |
| 2007/0217860 | A1 * | 9/2007 | Byun | 401/205 |
| 2008/0105328 | A1 * | 5/2008 | Desmond | 141/2 |
| 2009/0078591 | A1 * | 3/2009 | Hofman | 206/77.1 |
| 2009/0139884 | A1 * | 6/2009 | Kim | 206/277 |
| 2009/0145801 | A1 | 6/2009 | Moon | |
| 2010/0034574 | A1 * | 2/2010 | Zhang | 401/47 |

* cited by examiner

TRAVEL TOTE

CROSS REFERENCE TO RELATED APPLICATIONS

This application claims priority under 35 U.S.C. §119 to provisional application Ser. No. 61/754,270, filed Jan. 18, 2013, herein incorporated by reference in its entirety.

FIELD OF THE INVENTION

The present invention relates generally to a carrying apparatus. More particularly, but not exclusively, the invention relates to a portable travel tote or article for carrying, storing, and organizing a plurality of items, such as toiletries or the like.

BACKGROUND OF THE INVENTION

A vast variety of devices for carrying and storing shower toiletries is known. For example, shaving kits, caddies and the like are commonly employed. However, many of these are one sized, and include generic pockets, straps, or other members that contain or hold the stored items in place.

Many of the carrying devices are generic in size to allow for a variety of items to be carried therein. For example, the article may include one or more pockets where items can be stored. This leaves the items unorganized, and can greatly increase the size of the article by including larger items containing products. In addition, the article's unorganized design makes it difficult to find items, or to use the article in a shower.

The present systems for carrying toiletries, are, basically, little suitcases, bags, kits, or, caddies for a person's personal toiletries, which usually are too many and take up too much space to fit everything a person deems necessary—unless the person purchases multiple mini containers, which then limits the person's selection of products. The products are then stowed in the bag and either hung on the back of a door, or set on a counter, if available. Most of the present toiletry systems cannot be used in the shower since they are made from a material not conducive to use in water.

Travelers or anybody that has limited, or small showering space, or, who may be in a situation where it is far more convenient to have everything in one waterproof container to bring with them, such as going to the gym, living in a dorm, camping, missionaries, and hotel visitors, may benefit from utilizing this all in one device.

Other articles include built-in product containers that can store and dispense a product. However, as the containers are built into the article, they are difficult to refill, which can result in an empty container while away from home. In addition, these containers/dispensers take up a lot of room, and require that the article be able to be used wherever the product contained therein is to be used, e.g. in a shower. As a user may not want all of the contents or interior of the article to be exposed to water or a shower, this can prevent some uses of the article.

Therefore, there is a need in the art for a portable article that can be used to store items for travel in an organized manner, while also providing easy access to the items. There is also a need for a portable article that can be used in a plurality of settings and conditions.

SUMMARY OF THE INVENTION

Therefore, it is a primary object, feature, and/or advantage of the present invention to provide a portable article that improves over the state of the art.

It is another object, feature, and/or advantage of the present invention to provide a portable tote or article that includes an organized interior for storing articles during transport and/or use.

It is still another object, feature, and/or advantage of the present invention to provide a portable article that includes product-containing tubes removably connected to the article for storage and use.

It is yet another object, feature, and/or advantage of the present invention to provide a portable article that includes refillable, product-containing tubes.

It is a further object, feature, and/or advantage of the present invention to provide a plurality of holders in the article for holding additional items.

It is yet a further object, feature, and/or advantage of the present invention to provide a product-containing tube that includes a valve for selective dispensement of the product.

It is still a further object, feature, and/or advantage of the present invention to provide a portable article that can be used in wet or dry conditions.

These and/or other objects, features, and advantages of the present invention will be apparent to those skilled in the art. The present invention is not to be limited to or by these objects, features and advantages. No single embodiment need provide each and every object, feature, or advantage.

According to an aspect of the invention, a portable article is provided. The portable article includes a body comprising a first section and a second section foldably connected to one another, at least one protrusion extending from one of the first or second sections, and at least one tube comprising a tube body including an opening, a lid for covering the opening, and a tail opposite the lid, the tail including an aperture therethrough. The aperture of the tail is configured to attach to the at least one protrusion via a retaining member on the protrusion.

The article can further include one or more holders for retaining additional items within or attached to the article. Such a holder could include a pocket or bag, loops, magnets, elastic bands, or generally any other mechanism(s) that can retain, hold, or store items.

According to additional aspects of the invention, a refillable tube for use with a portable article such that a portion of the tube is removably connectable to a protrusion of the portable article is provided. The tube includes a tube body including an opening for receiving and dispensing product and an aperture through a portion of the tube body opposite the opening, and a lid for selectively closing the opening of the tube. The aperture through the tube body is configured to removably attach to the protrusion of the portable article to allow for quick and easy attaching and detaching of the tube from the portable article.

The tube can further include a valve member operatively attached to the opening of the tube body, in the opening or in the lid, and configured to allow one-way movement of the product relative to the tube. Furthermore, the aperture of the tube body can be through the body itself, or can be through a tail portion at a distal end of the body.

According to still additional aspects of the invention, a portable article is included. The portable article includes a body comprising a first section and a second section foldably connected to one another, a protrusion extending from one of the first or second sections, and a refillable tube for use with the portable article such that a portion of the tube is removably connectable to the protrusion of the portable article. The tube can include a tube body including an opening for receiving and dispensing product and an aperture through a portion of the tube body opposite the opening, and a lid for selectively closing the opening of the tube. The aperture through the tube body is configured to removably attach to the protrusion of the portable article to allow for quick and easy attaching and detaching of the tube from the portable article.

DETAILED DESCRIPTION OF THE PREFERRED EMBODIMENTS

Figure 1:
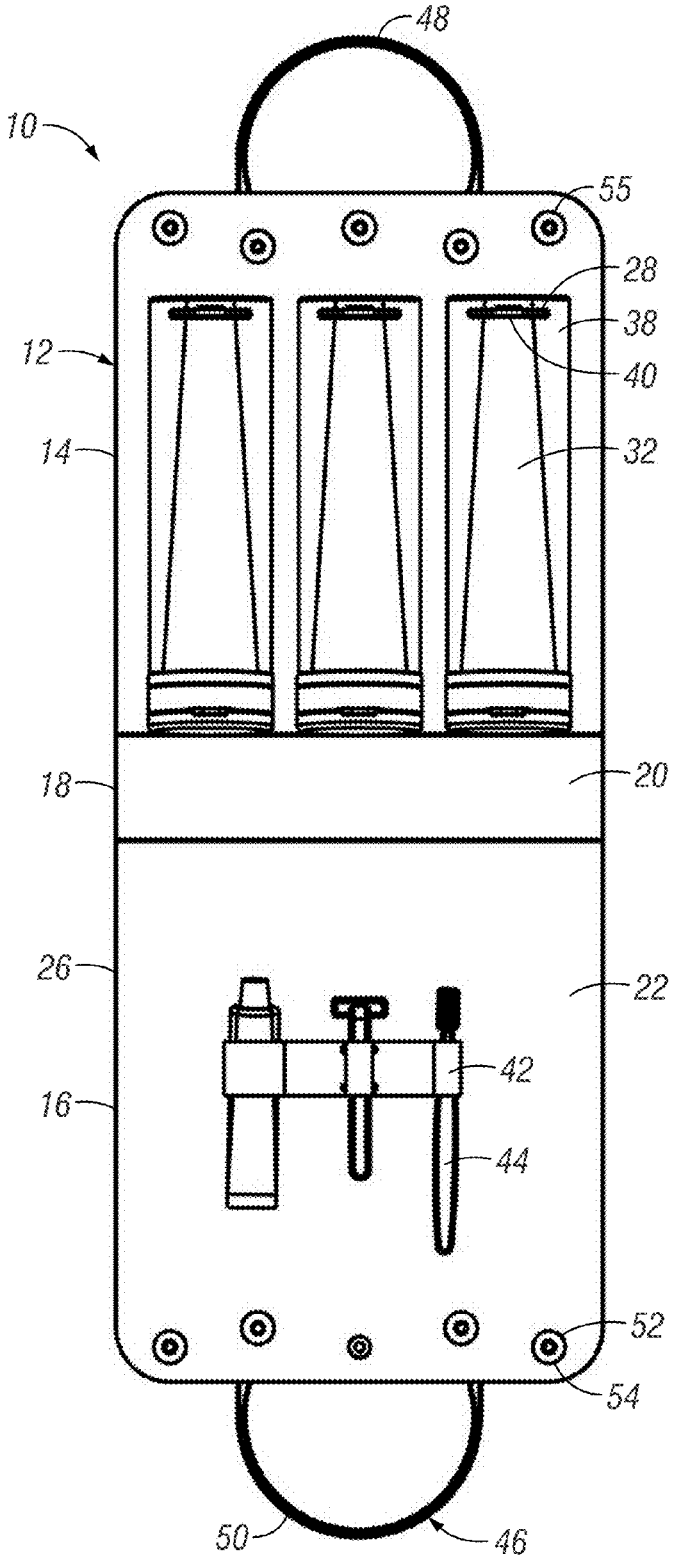
FIG. 1 is a front elevation view of the interior of an opened portable article according to an embodiment of the present invention.

FIG. 1 is a view of the interior 22 of a travel tote or portable article 10 according to an embodiment of the present invention. For purposes of the present invention, the terms travel tote and portable article will be interchangeable, and should not be limiting. A travel tote 10, such as that shown in FIG. 1, is commonly used for storing, transporting, and/or using a plurality of items 44. For example, a travel tote 10 such as that shown in FIG. 1 may be used on a vacation or other trip. Other instances of use may include living conditions where a user does not have access to a permanent storage for items, such as toiletries. For example, college students temporarily stay in dorms, which can include shared showers and restrooms. Therefore, the student may need to transport his/her toiletries to and from the shared restroom space from their room. The travel tote 10 shown in Figures can provide an organized manner to store, transport, and use such toiletries.

The travel tote 10 as shown in the Figures includes a body 12 comprising a first section 14, a second section 16, and a body connector area 18. The body connector 18 may or may not be required. For example, in some embodiments, the first and second sections 14, 16 of the body 12 may be directly connected to one another, which will allow for the sections to fold or otherwise move together or apart. However, the body connector 18 as shown in the Figures includes a section 20 to aid in providing some width when the first and second sections 14, 16 are adjacent one another in a closed position, i.e., folded together. The section 20 is hingedly connected to the first and second sections 14, 16 such that they fold relative to the section 20. However, extra material may also be attached at an edge 26 of the body 12 to provide for additional width or outside protection for a closed travel tote. The invention is not limited to the exact configuration and/or use of a connector 18 or additional material.

Figure 4:
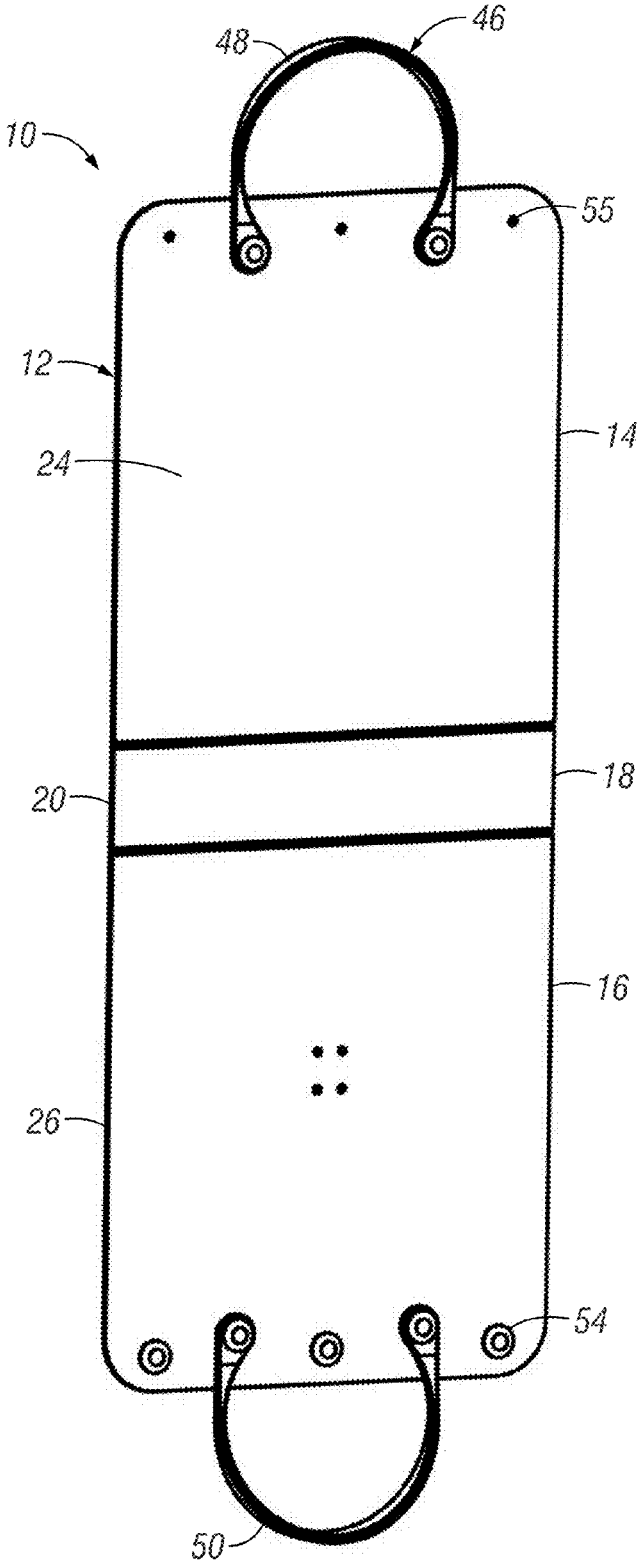
FIG. 4 is a rear view of an opened article.
Figure 8:
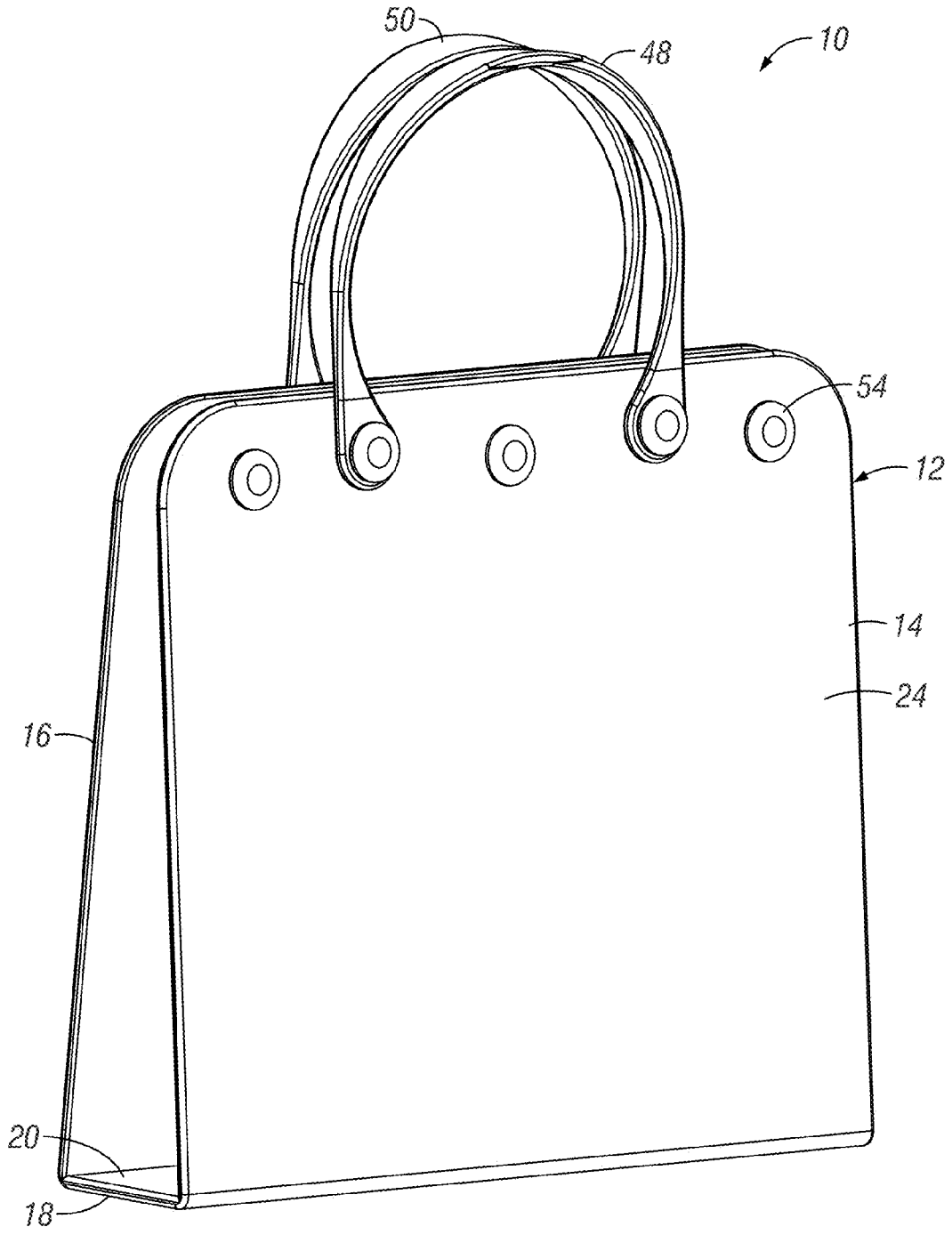
FIG. 8 is a perspective view of a portable article in a closed configuration.

The body 12 includes an interior side 20 and an exterior side 24. The body exterior 24 is shown generally in FIGS. 4 and 8. The body interior 22 can be used to organize, store, and even use some of the items 44 associated with the travel tote 10. As shown, such items 44 may include a toothbrush, razor, toothpaste, shaving cream, soap, or the like. However, other items or supplies may be stored in the article. For example, money, jewelry, or other items that need to be kept in a safe and secure place can be stored within the article 10. In addition, one or more tubes 32 may be stored at either the first or the second section of the body 12 of the travel tote 10. FIG. 1 shows a plurality of tubes 32 removably connected to the first section 16 of the interior 22 of the body 12.

Figure 5:
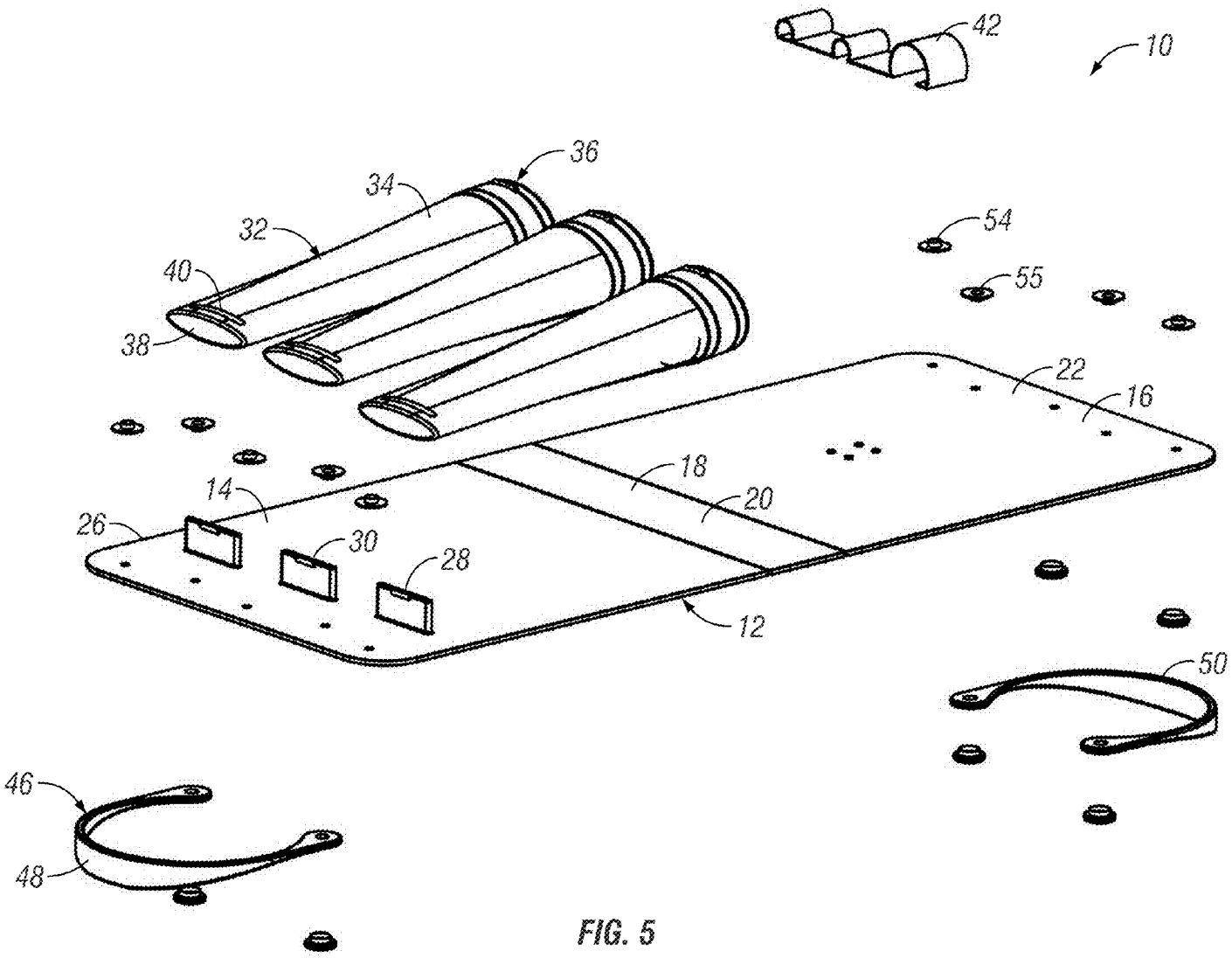
FIG. 5 is an exploded, perspective view of the interior side of an opened article.
Figure 6A:
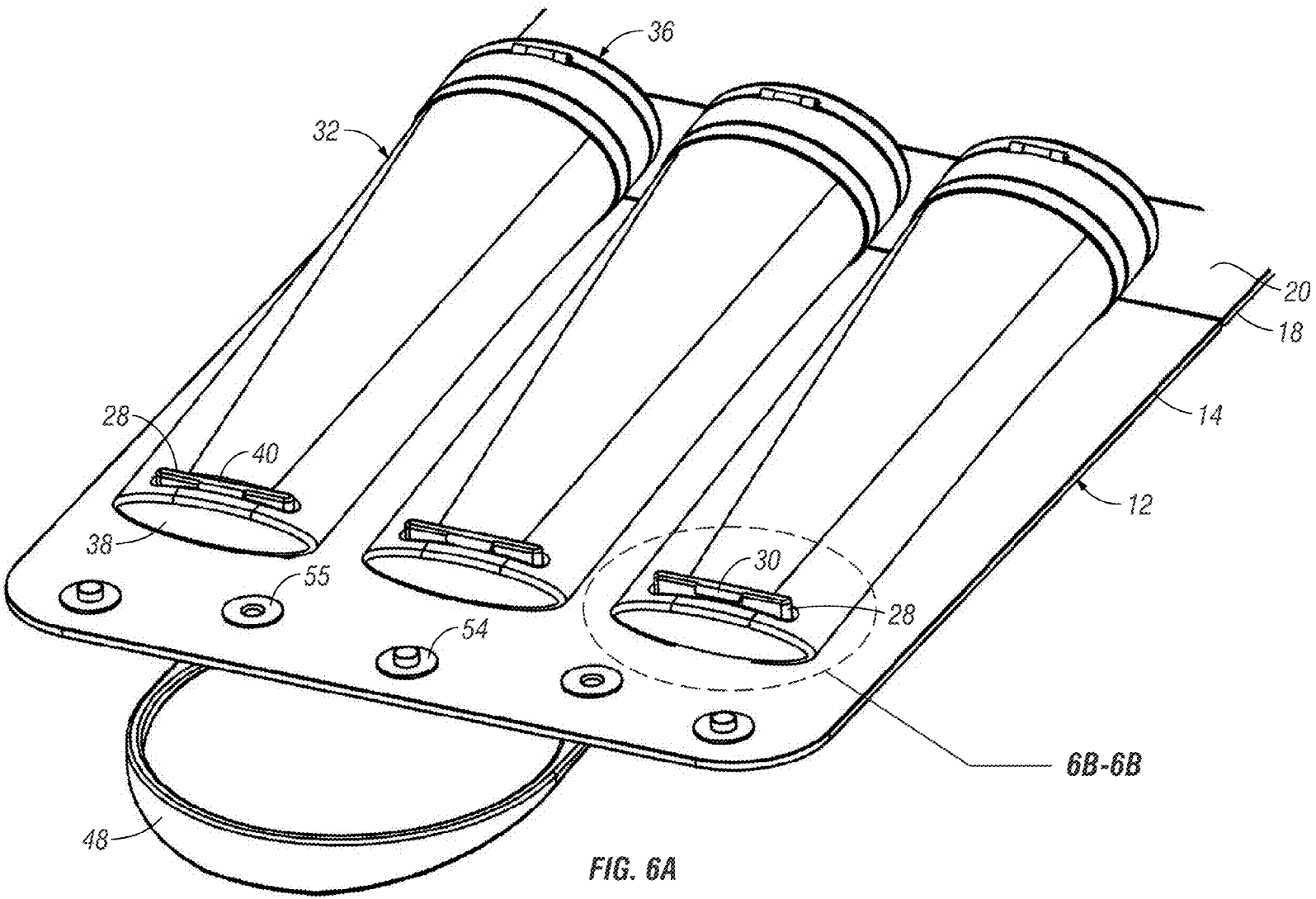
FIG. 6A is an enlarged view of a portion of an opened article showing tubes connected to an interior of the article.
Figure 6B:
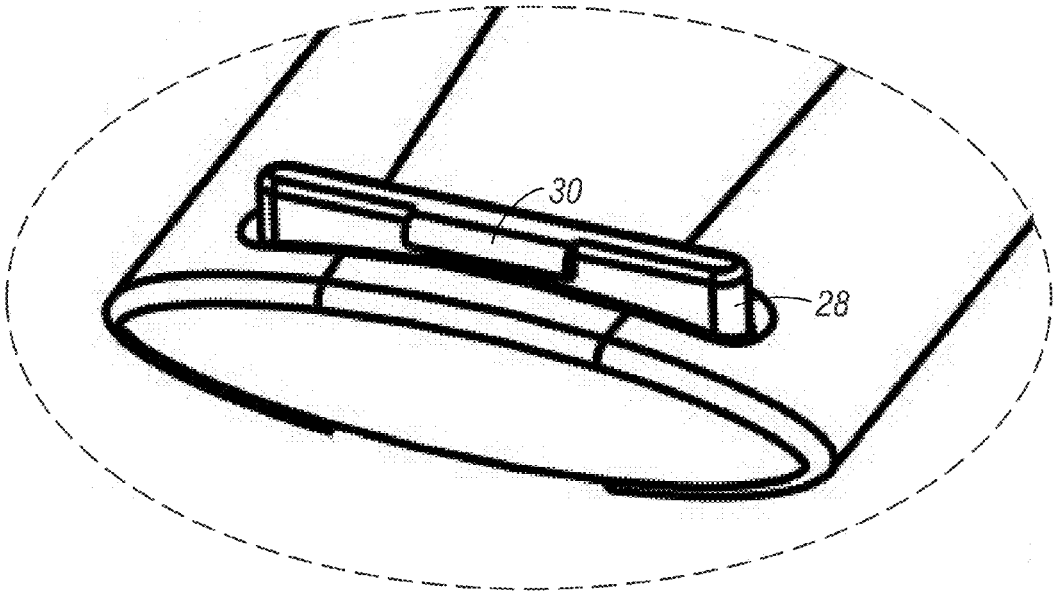
FIG. 6B is an enlarged view of a portion of the opened article of FIG. 6A showing the protrusion including a retaining member.

The body interior 22 includes a plurality of protrusions 28 extending therefrom, which are shown best in FIGS. 5, 6A, and 6B. The protrusions 28 can have a number that matches the number of tubes 32 to use therewith. While the Figures show three tubes, and thus three protrusions 28, it should be appreciated that the size of the travel tote 10, the size of the tube 32, as well as other factors may determine how many tubes can fit within the travel tote 10, and the invention contemplates any number of tubes being used. The protrusions 28 may be hook-like members and/or may include a retaining member 30, which can be a bump or other member positioned at or on the protrusion 28. One example of a protrusion 28 including a retaining member 30 is shown in FIG. 6B. The tube 32 includes a tail 38 at one end of the tube body 34, which includes an aperture 40 for attaching to the protrusion 28. The tail 38 may be a portion of the tube itself, or it could be a separate section that extends from the tube. The aperture 40 is sized to mate with the retaining member 30. Having the size of the retaining member 30 be at least slightly larger than a portion of the aperture 40 will allow the retaining member 30 to hold the tube 32 on or at the protrusion 28 while not in use. The tube 32 can be temporarily attached to the travel tote 10 via the retaining member 30 mating with at least a portion of the aperture 40 of the tail 38 of the tube 32 to retain the tube at the position shown in FIG. 1. However, the retaining member 30 may be sized to allow the tube to be removed from the protrusions 28 with little or limited force. For example, the tubes can be slid such that the retaining member 30 passes through the tail aperture 40 to allow a user to remove the tube 32 from the interior 22 of the travel tote 10.

The tubes 32 can contain a product for use by an individual. For example, one embodiment contemplates that at least one tube includes shampoo or soap. When the shampoo or soap is needed to be used by the user or owner of the travel tote 10, the tube can be quickly and easily removed from the protrusion 28. The tube 32, which includes a tube body 34 and a lid 36, can then dispense the product for use by the user. Once an amount has been dispensed, the tube 32 can be replaced on the protrusion 28 such that the travel tote 10 remains in an organized manner, with a tube being replaced to its original location. At this time one or more of the other tubes may be replaced and used as needed, followed by the being replaced to their associated protrusion 28. Likewise, any of the items 44 can be removed from a holder 42 for use. Once the item 44 has been used, the item 44 can be replaced to its associated holder 42 to insure organization of the interior 22 of the travel tote 10.

However, it should also be appreciated that the tubes 32 do not need to be removed in order to be used, and the product contained therein can be dispensed while the tubes are still attached to the travel tote 10. The tubes 32 may comprise silicone or soft rubber or another elastomer. This allows the tubes 32 to be able to be squeezed rather easily. Therefore, the tubes 32 could be squeezed or deformed while still connected to the tote section such that they will dispense the product while still connected. This makes the tote 10 easier to use, and lessens the chance that something will be dropped during use. However, allowing the tubes 32 to be removed makes it easier to refill the tubes for future uses.

The retaining members, which may also be known as holders 42, may be hooks, pockets, straps, adhesives, magnets, bags, protruded snaps, other protrusions, or the like. The holders 42 are used to maintain, hold, store, or otherwise maintain an item 44 in a position during transport and use of the item 44 and travel tote 10. Thus, the holders 42 may generally be any configuration such that they are able to hold an item 44 in place, while also aiding in organizing the contents of the travel tote 10. The holders 42 may also comprise the same material as the body 12 of the tote 10, or may comprise a different material altogether. For example, the holders 42 may comprise a material having a higher coefficient of friction to aid in holding the items 44 in place when not in use.

The body 12 of the travel tote 10 may comprise generally any material. For example, the body 12 may comprise a plastic or rubber material such that the body 12 will not become damaged if the travel tote 10 is used in wet conditions, such as in a shower. One type of material found suitable for the body 12 is a thermoplastic elastomer (TPE), also referred to as a thermoplastic rubber. Furthermore, both the interior 22 and exterior 24 of the body 12 may include designs, decals, labels, or the like, which may be custom designs to distinguish one travel tote from another. It is possible to add stickers or other personal touches to the travel tote 10 as well. Other materials capable of use of the body 12 of the travel tote 10 include molded rubber or other elastomers. However, it is contemplated that the present invention is not to be limited to the number and type of materials described herein. Furthermore, it is contemplated that the exterior 24 may comprise a different material then that of the interior 22. The exterior may include a material that is more durable and/or waterproof, while the interior may include a separate or different material.

Figure 2:
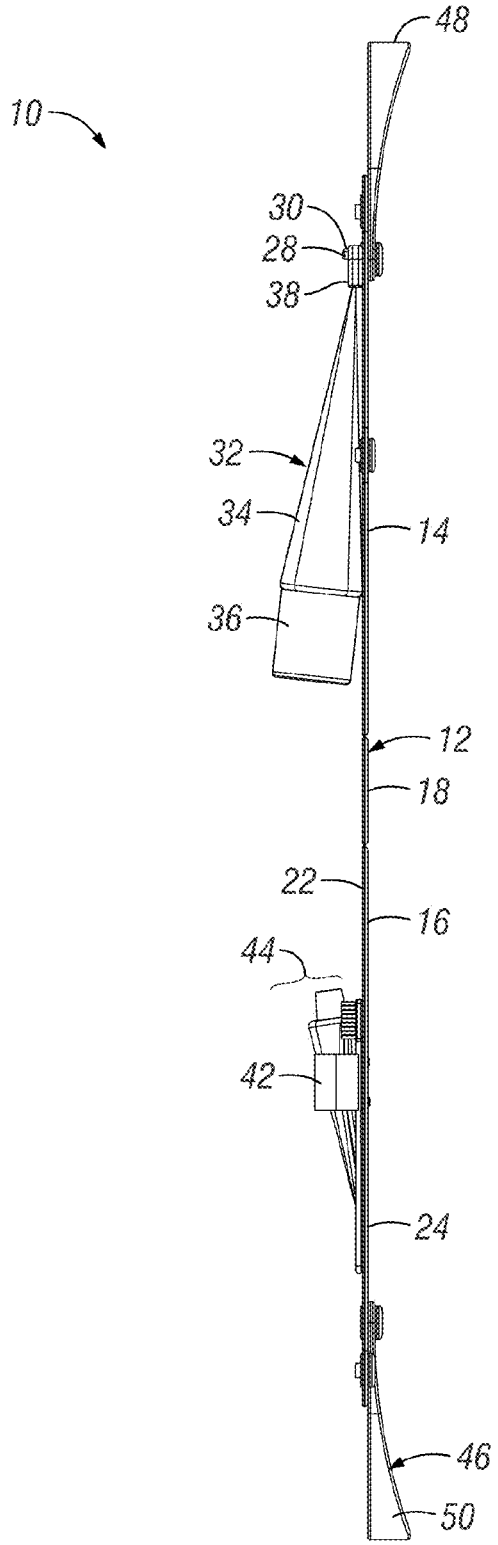
FIG. 2 is a side elevation view of an opened article.
Figure 3:
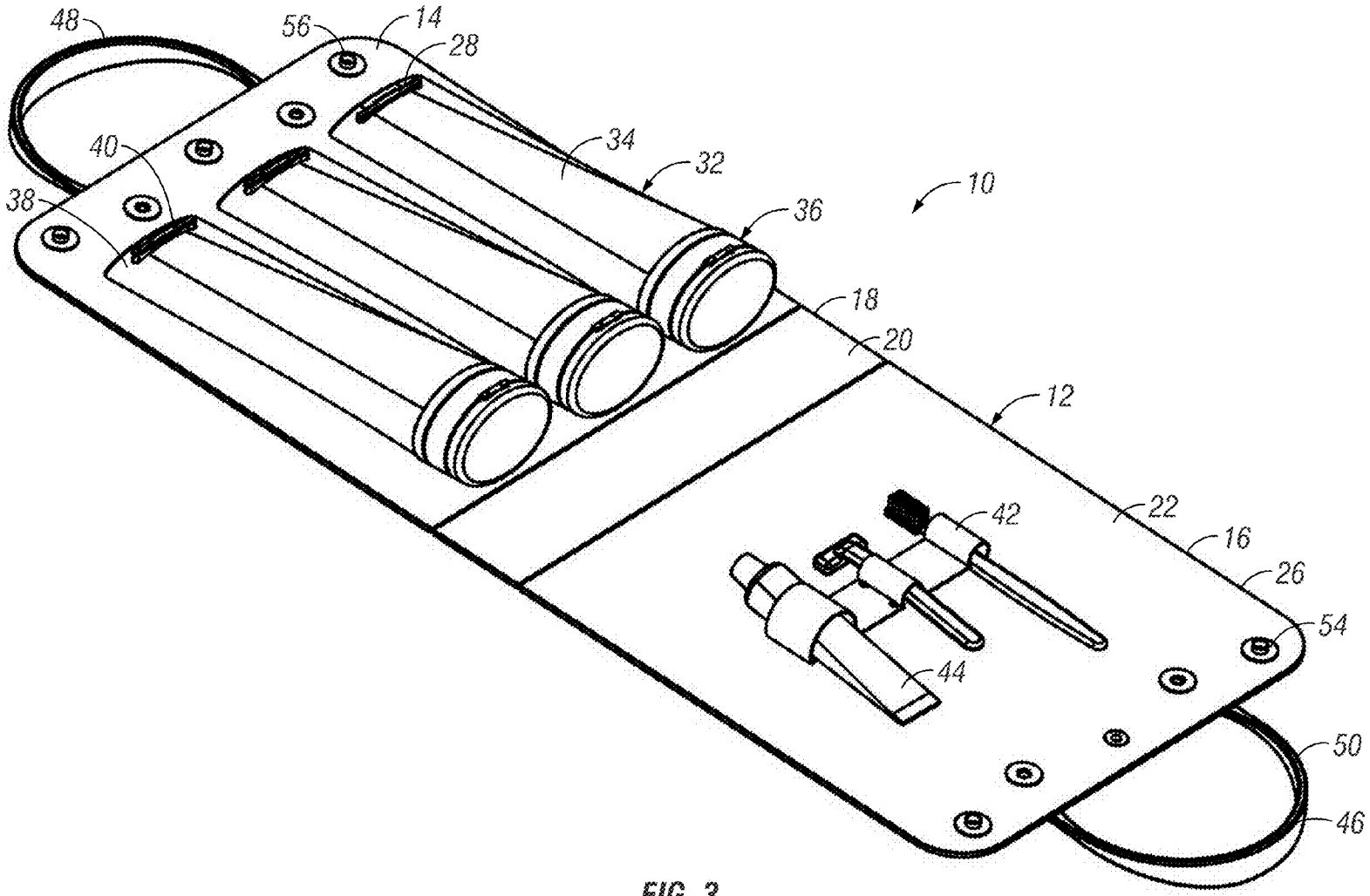
FIG. 3 is perspective view of an opened article.

Other components shown in the Figures include a handle 46 and a connection member 52. The handle 46 can be used to carry the travel tote 10 for transport, or also to hang the travel tote 10 at a destination where the contents of the travel tote 10 are to be used. For example, the handle 46 can be hung on a hook or showerhead such that the contents of the travel tote 10 can be used during showering or other steps of getting ready. Such a configuration is shown best in FIG. 2, which is a side view of the travel 10 in an open position. The handle 46 may comprise first and second sections 48, 50, which are connected to the first and second sections 14, 16 of the body 12, as shown best in FIG. 4. For example, the first section 48 of the handle 46 may be connected to the first section 14 of the body 12 via snaps 54 or other connecting devices. For example, while snaps 54 are shown, it should be appreciated that the handle may be sewn to the body 12, buttons may be used, adhesives may be used, hook and loops may be used, or the like. Likewise, the second section 50 of the handle 46 is shown to be attached to the second section 16 of the body 12 of the travel tote 10.

However, as shown in some embodiments of the tote 10, connection members 52 need not be required in all instances. Instead, the first and second sections 14, 16 may include snaps, magnets, or other connections means near or at the outer portions of the sections to selectively connect the sections together to place the tote 10 in a closed position. Furthermore, as shown in some embodiments, the lids 60 of the tubes 32 may be positioned generally at the section 20 such that when the tote 10 is in a closed position, the generally planar top of the lids 60 aid in balancing the tote 10. However, it should be appreciated that the ends of the tubes 32 may extend generally any length, and the tubes may be varied in length as well.

The travel tote 10 may also include connection members 52. The connection members can include additional material extending from sides of the first section 14 or second section 16 of the body 12. Thus, when the travel tote 10 is in a closed position, the snap 54 of the connection member 52 can be attached to the button 55 on the exterior of the second section 16 of the body 12. By connecting the first and second sections 14, 16 in this manner, the travel tote 10 can be maintained in a closed position. This may be beneficial during transport of the travel tote to and from locations such that the contents can remain private, and so that the contents do not fall out of the tote. However, other means of connecting the first and second sections 14, 16 of the body 12, contemplated. For example, hook and loops, snaps, buttons, magnets, adhesives, locks, or the like may be positioned on the first and second sections of the body 12 such that the sections will remain adjacent to one another in a closed position.

Furthermore, the present invention contemplates that additional items, such as venting holes, additional pockets or holders, battery packs, mirrors, clocks (both digital and analog), or the like may also be included with and/or attached to a portion of the travel tote 10. The components of the travel tote 10 may be modular in the fact that they can be personalized by a user. This would allow a user to be able to change the configuration of the travel tote 10 based upon factors such as the location of use and need of the user. The exact configuration shown in the figures is not to be the only embodiment covered by the present invention.

It should be appreciated that the travel tote 10 can be made in any number of shapes and sizes. For example, some agencies restrict the size of items that may be carried onto airplanes or other methods of travel. Therefore, a smaller tote 10, including many of the same features shown and described, can be utilized to meet these restrictions. Furthermore, the additional sizes contemplated by the invention allow for the tote to be used for many different occasions, while also allowing a more personalized manner of use. Some embodiments contemplate the addition of flip-flops or other sandals, shoes, etc., which may be used with, match, or otherwise go with the tote. Such shoes can be attached to the tote 10 such as by clip, pocket, magnets, or other means, to allow the shoes to be stored and used with the travel tote 10.

The tube 32 for use with the travel tote 10 may take many configurations. One configuration is shown in an exploded view in FIG. 7. The tube 32 includes a tube body 34 having a lid 60 operatively connected thereto at one end and a tail 38 at the opposite end. The term "tail" may describe an embodiment that includes a separate section of the tube extending from the tube body 34, or it may also include a distal end of the tube body itself, which is opposite the end of the lid 60. The tail 38 includes a tail aperture 40 passing therethrough and configured to connect to the protrusions 28 of the body 12. As is understood, the protrusions can include a retaining member 30 that is sized slightly larger than the aperture 40 of the tail 38 of the tube 32, such that the tube can be temporarily connected to the interior 22 of the body 12. In addition, a hook or other member can be positioned through the aperture 40 of the tube 32 to removably hold the tube 32 in place in the travel tote 10. The tube 32 is configured to hold a product for use by an individual. Examples of product may include lotion, shampoo, conditioner, soap, toothpaste, shaving cream, or other beauty or hair products, or the life.

Figure 7:
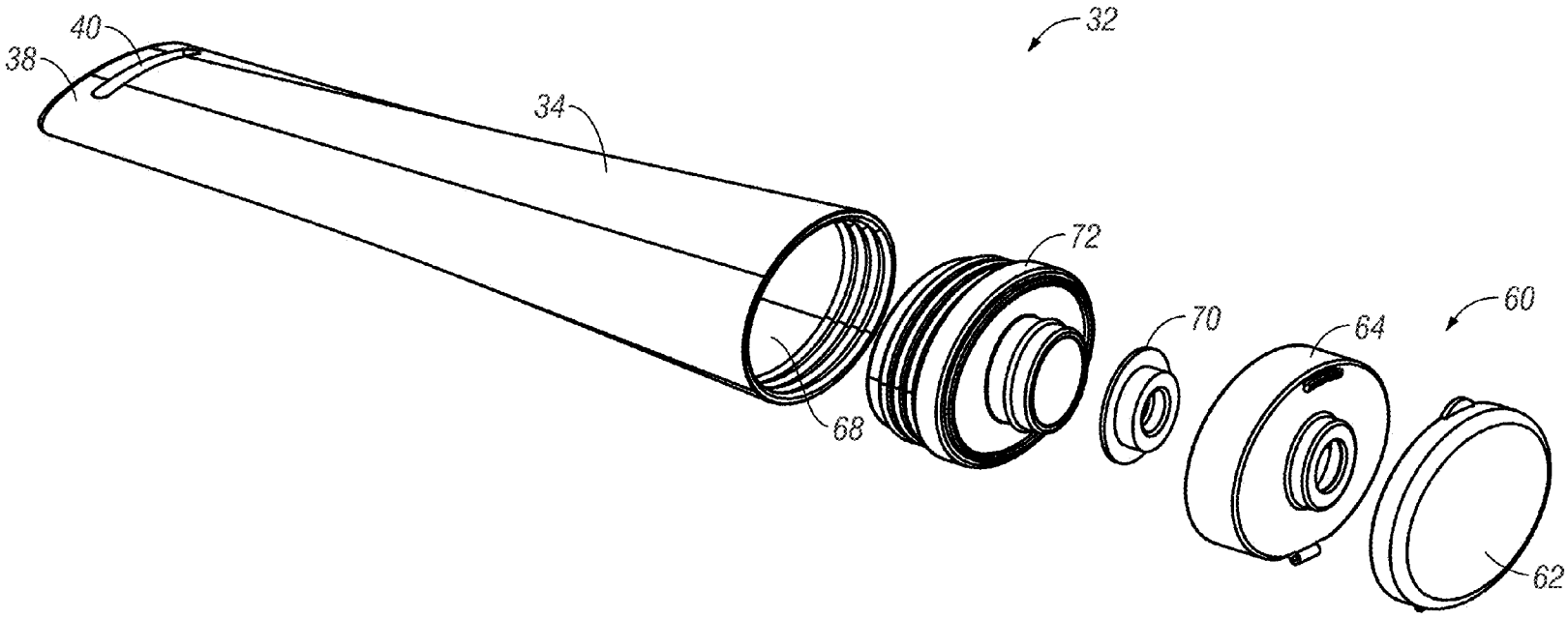
FIG. 7 is an exploded, perspective view of a tube assembly according to embodiments of the invention.

The lid 60 can a lid cover 62, which may be hingedly or fully removably connected to a lid body 64. A hinge 66 can allow the lid cover 62 to be selectively opened or closed to allow access to the product. The lid cover 62 can be snap fit to the lid body 64 such that the lid will remain in a closed position, such as that shown in the Figures. However, the snap may be overcome with little force such that the lid cover 62 can be opened as well. Also shown in FIG. 7 is a valve 70 that can be positioned within an opening of the tube lid or within an opening of the tube itself. The valve 70 allows for one way movement of the product contained within the tube 32 upon a squeezing or like force to the tube body 34. Thus, squeezing of the tube body 34 will open the valve 70 to allow the product to be dispensed therefrom. However, the valve will not allow water or other product to pass into the tube body 34, thus insuring the contents of the tube body 34 remain untainted. Thus, the valve 70 may be a check valve, ball valve, or generally any other type of valve.

FIG. 7 shows an embodiment of the tube 32 wherein the lid 60 can be fully removed from the rest of the tube 32. As shown, the end of the tube 32 having the tube opening 68 may include threading. The threading can match like threading at the interior of the lid 60 such that the lid is screwed or otherwise friction fit onto the tube body 34 to attach the lid thereto. It should also be noted that the valve 70 is located inside the tube lid 60, and not the opening 68 of the tube body 34. However, the valve 70 can be positioned in the tube opening 68 as well. Placing the valve in the lid 60 will allow the tube 32 to be refilled via the tube opening 68 when the lid 60 is removed from the tube body 34. As there is no one way valve 70 positioned in the opening 68, new product or a refilling amount of product can be inserted through the opening 68 to replenish the product within the tube 32.

FIG. 7 shows an exploded view of an embodiment of a tube 32 for use with the travel tote 10. The embodiments shown in the Figures may also include a tube top 72 that can be friction fit into the tube body 34 via snap ribs or the like. Other embodiments contemplate that, instead of ribs, the tube top and tube may include threaded sections that can be screwed to one another. Furthermore, the lid 60 itself may also include a threaded portion that can be screwed to threaded portions of the tube body 34. Having the tube top 72 be removable from the tube body 34 allows an even larger opening to the interior of the tube 32 such that the tube can be refilled or cleaned. As shown in FIG. 7, the valve 70, which may be a silicone valve, is positioned within the tube top 72, and the lid 60 is attached to the tube top 72. The lid 60 may be made to include a hinged snap top open, or may be a single piece that is snap fit onto the tube top 72.

Other aspects of the invention that are to be included, but which may not be shown include the use of a carrier bag for storing and/or transporting the travel tote 10. The carrier bag can comprise a waterproof material. This would allow the travel tote 10 of the invention to be packed in a suitcase or otherwise transported while portions of the tote 10 may still be wet. The waterproof carrier case can encapsulate the tote 10 to mitigate the transfer of the water from the tote to other items, such as clothes in a suitcase. Furthermore, as mentioned, the tote can be sized, along with the components housed within, to accommodate many different travel restrictions. The size of the tote, including the tubes, holders, handles, etc., can be changed to allow for smaller versions to be used for canyon situations, or when the tote is to be used as a makeup case or other smaller container.

It should be understood that additional changes and modifications to the embodiments shown and described herein will be apparent to those skilled in the art. Such changes and modifications may be made without departing from the spirit and scope of the invention, and without diminishing its advantages. It is intended, therefore, that such change and modifications be covered by the various aspects and embodiments of the invention.

What is claimed is:

1. A portable article, comprising:

a body comprising a first section and a second section foldably connected to one another;

at least one protrusion extending from one of the first or second sections, wherein said at least one protrusion includes a detent;

at least one holder attached to one of the first or second sections;

wherein the at least one holder is configured to removably attach at least one item;

at least one tube comprising a tube body including an opening, a lid for covering the opening, and a tail opposite the lid, the tail including an aperture therethrough;

a tube top positioned at least partially within the tube body opening for allowing selective access to within the tube body;

wherein the aperture of the tail is configured to removably attach the at least one tube to the at least one protrusion, said at least one protrusion configured to removably attach the at least one tube completely within an area defined by the first or second sections of the body; and wherein the tail of the at least one tube is separate than the tube body.

2. The portable article of claim 1 further comprising a plurality of holders on one of the first or second sections configured to retain an item.

3. The portable article of claim 1 further comprising at least one handle extending from an end of the first or second sections.

4. The portable article of claim 1 further comprising connection members attached to the body and configured to retain the first and second sections in a closed position.

5. The portable article of claim 4 wherein the connection members comprise snaps operatively connected to the body.

6. The portable article of claim 4 wherein the connection members comprise hook and loops operatively connected to the body.

7. The portable article of claim 1 wherein the at least one tube further comprises a valve positioned at the opening to selectively dispense a product contained within the tube.

8. The portable article of claim 1 wherein a body connector comprises a hinge connecting the first and second sections to one another.

9. A portable article, comprising:

a body comprising a first section and a second section foldably connected to one another;

at least one protrusion extending from one of the first or second sections, wherein said at least one protrusion includes a detent;

at least one holder attached to one of the first or second sections;

wherein the at least one holder is configured to removably attach at least one item;

at least one tube comprising a tube body including an opening, a lid for covering the opening, and a tail opposite the lid, the tail including an aperture therethrough;

a tube top positioned at least partially within the tube body opening for allowing selective access to within the tube body;

wherein the aperture of the tail is configured to removably attach the at least one tube to the at least one protrusion, said at least one protrusion configured to removably attach the at least one tube completely within an area defined by the first or second sections of the body; and wherein the tail of the at least one tube is part of the tube body.

10. A portable article, comprising:

a body comprising a first section and a second section foldably connected to one another;

at least one protrusion extending from one of the first or second sections, wherein said at least one protrusion includes a detent; and a refillable tube for use with the portable article such that a portion of the tube is removably connectable to the protrusion of the portable article, the tube comprising:

a tube body including an opening for receiving and dispensing product and an aperture through a portion of the tube body opposite the opening;

a tube top positioned at least partially within the tube body opening for allowing selective access to within the tube body; and a lid for selectively closing the opening of the tube;

wherein the aperture through the tube body is configured to removably attach to the at least one protrusion of the portable article, said protrusion configured to removably attach the refillable tube such that the refillable tube is stored completely within an area defined by the body of the portable article.

11. The portable article of claim 10 further comprising a plurality of tubes connected to the body of the article for storing product.

12. The portable article of claim 10 wherein the refillable tube further comprises a valve positioned at the opening to selectively dispense a product contained within the tube.

13. The portable article of claim 10 wherein the aperture of the tube body is positioned through a tail portion at a distal end of the tube body and extending from the tube body.

* * * * *